United States Patent [19]

Drake et al.

[11] 4,265,450

[45] May 5, 1981

[54] METAL RACKETBALL RACKETS

[75] Inventors: Charles A. Drake; Raymond M. Bayer, both of San Diego, Calif.

[73] Assignee: Leach Industries, San Diego, Calif.

[21] Appl. No.: 45,406

[22] Filed: Jun. 4, 1979

[51] Int. Cl.[3] ..... A63B 49/12

[52] U.S. Cl. ..... 273/73 G; 273/73 R; 273/73 H; 273/73 J

[58] Field of Search ..... 273/73 R, 73 C, 73 D, 273/73 G, 73 H, 73 J, 73 L

[56] References Cited

U.S. PATENT DOCUMENTS

| | | | |
|---|---|---|---|
| 1,173,588 | 2/1916 | Larocque | 273/73 H |
| 1,541,828 | 6/1925 | Larned | 273/73 H |
| 2,456,023 | 12/1948 | Rosenbalm | 273/73 H |
| 2,969,984 | 1/1961 | Presnick | 273/73 L X |
| 3,547,440 | 12/1970 | Deer | 273/73 G X |
| 3,582,073 | 6/1971 | Melnick et al. | 273/73 G X |
| 3,664,669 | 5/1972 | Latham et al. | 273/73 G X |
| 3,899,172 | 8/1975 | Vaughn et al. | 273/73 H X |
| 4,066,260 | 1/1978 | Rodgers | 273/73 H X |

FOREIGN PATENT DOCUMENTS

| | | | |
|---|---|---|---|
| 1009270 | 4/1977 | Canada | 273/73 L |
| 2010450 | 9/1971 | Fed. Rep. of Germany | 273/73 D |
| 568037 | 12/1923 | France | 273/73 G |
| 2205 | of 1911 | United Kingdom | 273/73 G |

*Primary Examiner*—Richard J. Apley

*Attorney, Agent, or Firm*—LeBlanc, Nolan, Shur & Nies

[57] ABSTRACT

A racketball racket comprises a metal frame in the form of a single strip of metal of substantially uniform cross-section bent intermedially to provide a head portion that defines the striking area and merges through a reversely curved throat portion to side by side ends for providing a handle portion and a rigid throat piece element extending across said frame at the throat portion and defining the inner margin of said striking area. The opposite ends of the throat element are attached to said strip at said throat portion by tongue and slot connection regions wherein the lateral flexibility of the frame is maintained substantially the same as in other parts of the frame in the head portion. In making the racket the string receiving holes in the head and the slots for mounting the throat piece element are formed in the strip after it has been bent to the condition it assumes in the final assembly.

7 Claims, 9 Drawing Figures

FIG. 1
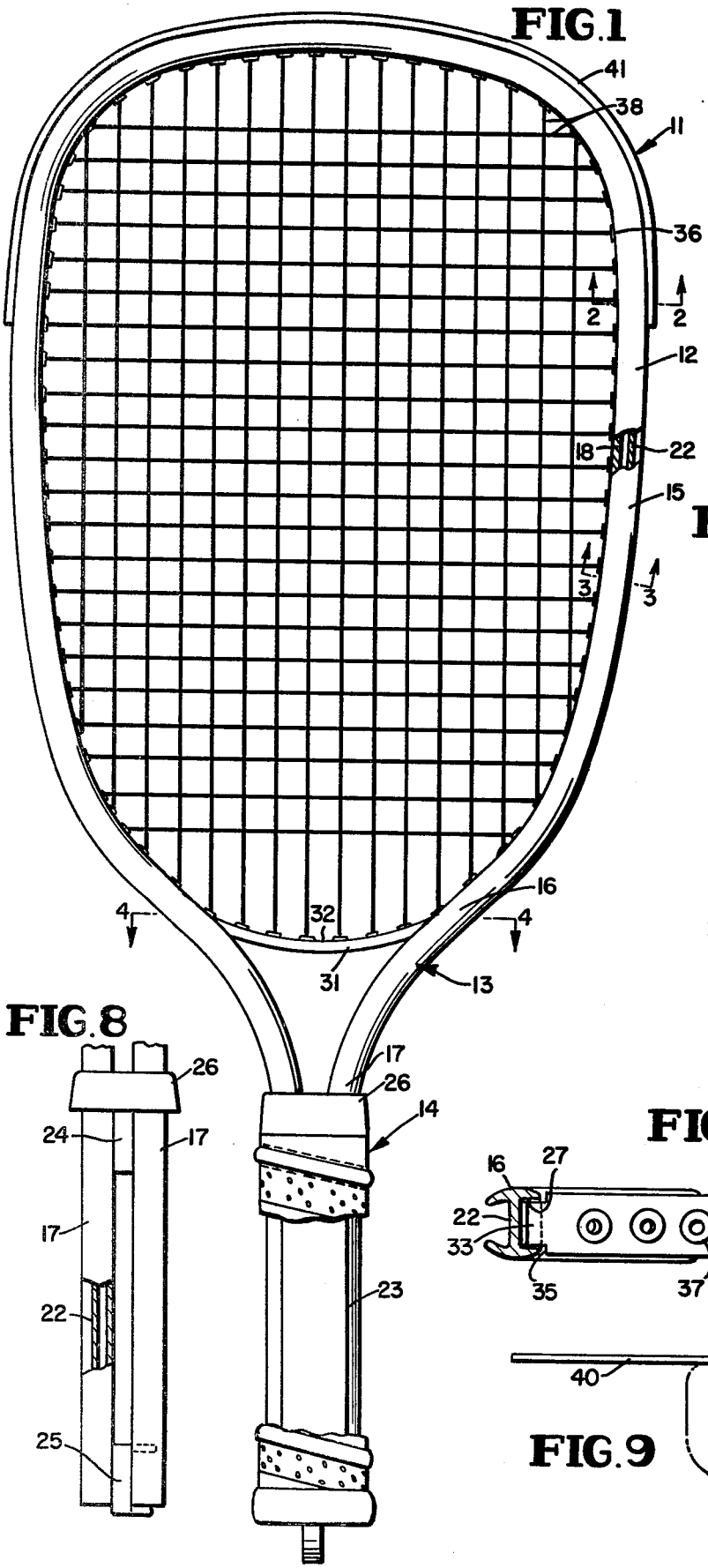
FIG. 2
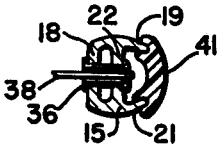
FIG. 3
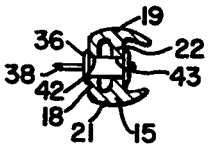
FIG. 6
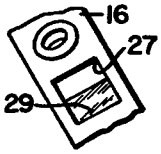
FIG. 7
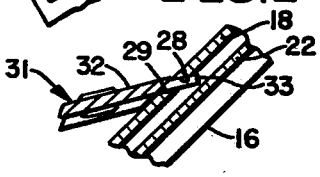
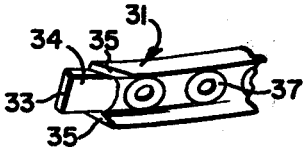
FIG. 5
FIG. 8
FIG. 4
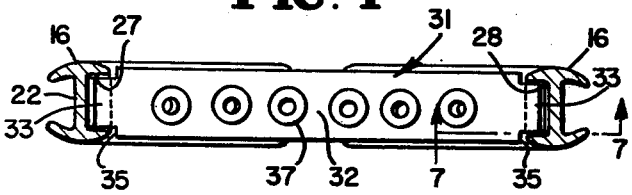
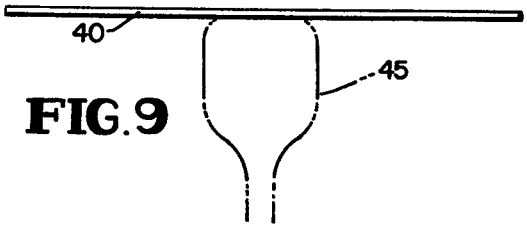
FIG. 9

METAL RACKETBALL RACKETS

This invention relates to metal racketball rackets and the like, and is particularly concerned with rackets of this kind wherein a relatively lightweight frame has a uniformly flexible head and throat construction that provides for improved accuracy and play action in general; and it involves a novel method of making such rackets.

In its preferred embodiment the invention contemplates a racket of the type wherein the frame is composed of a single length strip of a suitable lightweight metal such as aluminum with the intermediate portion of the strip formed as by bending to provide a more or less oval head outline and the opposite ends of the strip are reversely bent through a throat region and secured relatively closely together in parallel side by side relation and enclosed by a covered housing to form a handle. The length or strip of metal as extruded is of generally channel type in transverse cross section and the channel is outwardly open in the formed frame, and in the extruded strip of the preferred embodiment a web extends between the legs of the channel in spaced relation to the base of the channel.

It is known generally to provide a racket wherein a single length of metal of channel shape is bent with the channel facing outwardly to intermediately form the head outline, provide a reversely curved throat region and to bring the opposite ends into parallel relation at the handle. Such is disclosed for example in Norton U.S. Pat. No. 1,637,583. The concept of an extruded aluminum frame is disclosed in Latham U.S. Pat. No. 3,625,512 and Held U.S. Pat. No. 3,664,668.

In most of the known metal rackets a throat piece is provided at the throat region which is integral or otherwise rigidly secured to the frame and shaped arcuately oppositely to the outer end of the head so as to in effect define the inner end of the striking area. These throat pieces are also formed with openings accepting part of the stringing.

Prior to the invention it was considered advantageous that the throat piece specially reenforce the frame at the throat portion, and the points of attachment of the throat piece to the frame usually deliberately stiffen the frame in the throat piece region thereby reducing the lateral flexibility in that region.

An important feature of novelty here is the discovery that for advantageous results the frame in the throat region should be maintained with the same lateral flexibility as in the remainder of the head, and this is a major object of the invention.

An important object of the invention is to provide a novel metal racketball racket wherein a fixed throat piece extends across the inner end of the head with provision for stringing and is attached to the frame at the throat region in a manner resulting in a minimum or no change of lateral flexibility in the frame at the throat region.

Another object of the invention is to provide a novel metal racketball racket having a frame formed by bending a single length of lightweight metal channel to define the head outline and a reversely curved throat region at the inner end of the head and a rigid throat element extends across the inner end of the head to be frictionally mounted at opposite ends in special tongue and slot connection with the frame.

Another object of the invention is to provide a novel method of manufacturing a racketball racket wherein a single strip of channel cross section aluminum or like lightweight metal is bent to form the head outline and reversely curved at the inner end of the head to form a throat region from which the opposite ends extend together in the handle, the step of locating and forming stringing or eyelet holes in the frame only after the strip has been bent to so attain its substantially final frame shape. Pursuant to this object slots for mounting opposite ends of a throat piece element are formed in the bent strip in the throat region.

Further novel features and other objects of this invention will become apparent from the following detailed description, discussion and the appended claims taken in conjunction with the accompanying drawings.

BRIEF DESCRIPTION OF DRAWINGS

FIG. 1 is a plan view of a racket according to a preferred embodiment of the invention;

FIG. 2 is a section substantially at line 2—2 of FIG. 1;

FIG. 3 is a section substantially at line 3—3 of FIG. 1;

FIG. 4 is a section substantially at line 4—4 of FIG. 1;

FIG. 5 is a fragmentary view showing one end of the throat piece;

FIG. 6 is a fragmentary view showing a recess for accepting one end of the throat piece;

FIG. 7 is a fragmentary section showing the end fit of the throat piece into the frame recess;

FIG. 8 is a fragmentary elevation showing the handle with the retaining housing removed; and FIG. 9 is a diagrammatic view for illustrating the method phase of the invention.

PREFERRED EMBODIMENTS

The drawings show the invention as incorporated in a racket ball racket 11 having a head portion 12 merging into a throat portion 13 that further merges into a handle portion 14.

The racket frame comprises a single uniform cross section length of metal that is medially bent and shaped to the desired head outline, as indicated at 15 and the opposite ends are reversely curved to define the throat 16 and then extended in parallel terminals 17 at the handle.

This length of metal is an extruded aluminum or aluminum alloy strip of uniform cross section. FIGS. 2 and 3 show the cross section of the strip as extruded. It is essentially a U-shaped channel with a base 18 that defines the inner periphery of the racket head frame section and surrounds the striking area and arms 19 and 21 outwardly extending from the opposite ends of the base. As shown arms 19 and 21 may present an externally rounded appearance and may curve slightly toward each other. A spaced web 22 generally parallel to base 18 bridges the arms at about their mid portions.

In the racket of the invention the entire frame has the cross section of FIGS. 2 and 3 except for minor regions of the throat as will appear.

The frame terminals 17 extend within a handle housing that is preferably a fitted one piece tubular plastic member 23 closed at the bottom and open at the other end. In FIG. 8 the housing is removed to show the spacers 24 and 25 disposed between the terminals 17, which spacers are also used within the housing of FIG. 1. The inner spacer 24 is preferably an extension of a cap 26 that slidably fits on the terminals and otherwise closes the open end of housing 23. The housing 23 is preferably secured to terminals 17 as by suitable through rivets.

At the opposite inner sides of the throat opposed recesses 27 and 28 (FIGS. 4 and 6) are formed in base 18 of the strip. Preferably these recesses are located just before the curve of base 18 starts to reverse at the inner end of the head, and each preferably has along its lower edge an inclined entrance surface as shown at 29 in FIGS. 6 and 7.

A rigid throat piece element 31 extends across the frame at the inner end of the head with its opposite ends fitted into recesses 27, 28. Throat piece 31 is preferably an extruded aluminum bar or like element and is arcuate so that its inner surface 32 smoothly merges into the curved surfaces of base 18 at opposite sides. As shown in FIGS. 5 and 7 the ends of throat piece 31 are formed as projecting tongues 33 having smooth surfaces 34 that slidably move over inclined surfaces 29 as the tongues move into recesses 27, 28. The width of tongues 33 is slightly less than the width of recesses 27, 28 so that the shoulders 35 (FIG. 4) abut the base 18 in the assembled condition when frame terminals 17 are parallel.

The base 18 around the head is provided with eyelets 36 for accepting the stringing and these eyelets extend between base 18 and web 22 as shown in FIGS. 2 and 3. The throat piece 31 which bounds the inner end of the head is also provided with eyelets 37. The eyelets are of the same diameter and are equally spaced along the head frame portion and throat piece.

When the frame is assembled with the handle and throat piece 31 in place, the head area is completed by conventional stringing. As shown in FIGS. 2 and 3 the strings 38 all pass through eyelets, thereby reducing wear and aiding uniform tension.

Preferably a bumper strip 41 is secured upon the outer periphery of the head as shown in FIGS. 1 and 2. This bumper strip preferably is a length of abrasion resistant plastic the opposite side edges of which are slotted to snap fit over the ends of arms 19 and 21 as shown in FIG. 2. Strip 41 extends over the outer end of the head and about one-third along each side, and it protects the frame against damage when the player strikes the head against a concrete or like floor as for example when he picks up a ball with the racket.

FIG. 9 shows diagrammatically the novel method of manufacturing the racket of the invention. The frame material is provided in the form of a strip 40 of extruded aluminum of the required channel cross section and sufficient length.

This strip is placed in a tool assembly (not shown) wherein it is bent to substantially the required final form as indicated at 45, that is to shape and locate the head, throat and parallel terminals as they will appear in the finished racket.

The strip is now held in this condition 45 while all of the eyelet receiving holes (see 42, 43 in FIG. 3) are drilled, and recesses 27, 28 are milled into base 18. It has been found that this novel step of forming the eyelet holes and throat piece mounting recesses in the bent frame ensures symmetry and that in the final racket the strips are properly located and that the throat piece, which is separately formed, fits accurately onto the frame.

After the holes and slots are formed the bent strip is removed from the tool assembly, polished to remove surface defects and anodized for better surface appearance.

After the eyelet holes are drilled and the recesses 27, 28 formed, the separately formed throat piece 31 which already has eyelets 37 installed and has been anodized is mounted on the frame by slightly separating the terminals 17 until the opposite tongues 33 may slide into recesses 27, 28; and then the handle is mounted on the terminals 17. As the handle housing slides over the terminals 17 it finally locates and holds the terminals 17 in parallelism and it pulls the opposite sides of the throat toward throat piece 31 until shoulders 35 abut the base 18. Thus the handle housing acts to hold the throat piece 31 in proper position and no other fastening is needed to hold the throat piece on the racket.

Now the eyelets 36 are installed in the head portion, the handle is wrapped to provide a firm grip, the bumper strip is installed, and finally the stringing is done in the head area.

Advantageously in the invention the frame, particularly throughout the head and throat is maintained of substantially the same cross section and therefore the lateral flexibility at the throat is maintained substantially the same as is the head. This is a departure from previous attempts to stiffen the throat and one noticeable advantage is that the racket performs better when the ball strikes the inner part of the head area near the throat and effectively jams the player.

The size of recesses 27, 28 is kept to a minimum, preferably only relatively narrow transverse slots being necessary with the throat piece end tongues filling the slots in the assembly, so that the throat piece mounting does not noticeably change the later flexibility of the frame at the throat.

Preferably the racket frame is composed of an aluminum alloy that permits a desired shape retaining cross section of minimum area while providing reduced weight and adequate flexibility without elasticity. The preferred alloy now is that identified as Aluminum Alloy 6061 made by Aluminum Company of America.

The approximate metallurgical composition of this 6061 alloy is believed to be:

| ELEMENT | % |
|---|---|
| Magnesium | 1.0 |
| Silicon | 0.6 |
| Copper | 0.25 |
| Chromium | 0.25 |
| Aluminum | balance |

The important physical properties of this alloy 6061 in the extruded shapes used in the foregoing rackets are on the average:

| ALLOY & TEMPER | TENSILE STRENGTH (psi) ULTIMATE MIN. | ULTIMATE MAX. | YIELD MIN. | YIELD MAX. | ELONGATION % Min. in 2 in. |
|---|---|---|---|---|---|
| 6061-0 | | 22,000 | | 16,000 | 16 |
| 6061-T4 | 26,000 | | 16,000 | | 16 |
| 6061-T6 | 38,000 | | 35,000 | | 10 |

For some rackets a higher tensile strength metal is preferable, and here it may be preferable to use a different aluminum alloy, namely Aluminum Alloy 7005 made by Aluminum Company of America.

The appropriate average metallurgical composition on this alloy 7005 is believed to be:

| ELEMENT | % |
|---|---|
| Manganese | 0.20–0.70 |
| Magnesium | 1.0–1.8 |
| Zinc | 4.2–5.0 |
| Titanium | 0.04 |
| Chromium | 0.1 |
| Zirconium | 0.1 |
| Aluminum | balance |

The important physical properties of this alloy 7005 in the extruded shapes used in the foregoing rackets are on the average:

| ALLOY & TEMPER | TENSILE STRENGTH ULTIMATE | TENSILE STRENGTH YIELD | ELONGATION % Min. in 2 in. |
|---|---|---|---|
| 7005-T62 | 53,000 | 45,000 | 14 |
| 7005-T53 | 57,000 | 50,000 | 15 |
| 7005-T6 | 54,000 | 46,000 | 12 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A racketball racket comprising a metal frame in the form of a single strip of metal of substantially uniform cross-section bent intermedially to provide a head portion that defines the striking area and merges through a reversely curved throat portion to terminate in side by side parallel end portions, a rigid throat element extending across said frame at the throat portion and defining the inner margin of said striking area, means frictionally mounting opposite ends of said throat element in said frame at said throat portion in connection regions wherein the lateral flexibility of the frame is maintained substantially the same as in other parts of the frame in the head portion, and a handle assembly enclosing said end portions for maintaining said end portions in parallelism and urging opposite sides of said throat portion towards said throat element thereby positively maintaining said throat element in tight assembly with said frame, said handle assembly being the sole means by which said throat element is retained by said frame.

2. The racketball racket defined in claim 1, wherein said connection regions comprise interfitting tongue and recess formations.

3. The racketball racket defined in claim 2, wherein said strip is in the form of an outwardly open channel the base of which extends around said striking area, and said connection regions comprise slots in the channel base at opposite sides of the throat portion and tongues on the ends of said throat element frictionally received in said slots.

4. The racketball racket defined in claim 3, wherein said throat element is an arcuate metal bar and said tongues are reduced width end extensions of said bar.

5. The racketball racket defined in claim 4, wherein tubular housing means is provided in said handle assembly surrounding said end portions for holding the end portions parallel and urging the frame sides together at said throat portion whereby the channel base at the opposite edges of the respective slots is urged into tight contact with shoulders on said bar provided by said reduced width tongues.

6. In the racket defined in claim 1, said handle assembly comprising a tubular housing surrounding said end portions and fixed spacer means between said end portions.

7. A method of manufacturing a racketball racket comprising the steps of bending a strip of lightweight metal intermediate its ends to provide a head portion, a reversely curved throat portion and adjacent side by side ends providing a handle portion, said strip being of channel cross-section with the base of the channel defining the margin of the striking area within the head portion, holding said strip in the bent condition that corresponds with that it will occupy in final assembly, and while the strip is so held (a) forming in said base along the head portion and adjacent sections of the throat portion a series of string or string eyelet receiving holes and (b) forming opposed recesses in the base at the throat portion for frictionally mounting a throat piece, placing a throat element in the throat portion with its opposite ends frictionally received in said recesses, and fitting a handle housing onto said side by side frame ends to effectively urge the strip ends and the sides of said throat toward each other and hold the throat piece in assembly whereby said handle assembly constitutes the sole means by which said throat element is retained by said frame.

* * * * *